US005573155A

United States Patent [19]

Sadler

[11] Patent Number: 5,573,155

[45] Date of Patent: Nov. 12, 1996

[54] BACKPACK ASSEMBLY

[76] Inventor: Stephen Sadler, 232 Edgewater Blvd., St. Clair Beach, Ontario, Canada, N8N 2H2

[21] Appl. No.: 461,508

[22] Filed: Jun. 5, 1995

[51] Int. Cl.[6] ..... A45F 4/02

[52] U.S. Cl. ..... 224/155; 224/153; 224/907

[58] Field of Search ..... 224/155, 156, 224/151, 907, 204, 153; 297/4

[56] References Cited

U.S. PATENT DOCUMENTS

| | | | |
|---|---|---|---|
| 33,385 | 10/1861 | Frodsham . | |
| 990,837 | 5/1911 | Carlson . | |
| 2,421,244 | 5/1947 | Daiber | 224/25 |
| 2,922,465 | 1/1960 | Johansson | 155/123 |
| 3,241,734 | 3/1966 | Gray | 224/9 |
| 3,885,722 | 5/1975 | Robertson | 224/25 |
| 4,676,548 | 6/1987 | Bradbury | 224/155 |
| 4,830,245 | 5/1989 | Arakaki | 224/210 |
| 4,925,064 | 5/1990 | Comora | 224/209 |
| 4,947,498 | 8/1990 | Van Boxtel | 224/155 |
| 5,004,135 | 4/1991 | Dufournet et al. | 224/907 |
| 5,320,262 | 6/1994 | Levis | 224/210 |
| 5,366,126 | 11/1994 | Dausien | 224/211 |

*Primary Examiner*—David J. Walczak

*Attorney, Agent, or Firm*—Gifford, Krass, Groh, Sprinkle, Patmore, Anderson & Citkowski, P.C.

[57] ABSTRACT

An apparatus of the type adapted to be carried on the back of a person. The apparatus includes a pack having a front panel and a rear panel which define a chamber therebetween in which articles can be stored and carried. A pair of shoulder straps are secured to the pack such that, with the straps positioned over the shoulders of a person, the front panel faces and is generally parallel to the back of a person. The apparatus further includes a pad assembly having a first and second generally planar pads, each having a top, bottom and two sides. The bottoms of the pads are pivotally secured together between a first position in which the first pad overlies and is substantially parallel to the second pad, and a second position in which the plane of the first pad is substantially perpendicular to the plane of the second pad. The top and sides of the first pad are secured to the top and sides of the second panel so that, with a back of a chair positioned in between the first pad and first panel, the chair supports as the pack behind the back of the chair.

6 Claims, 2 Drawing Sheets

BACKPACK ASSEMBLY

BACKGROUND OF THE INVENTION

I. Field of the Invention

The present invention relates generally to carriers and, more particularly, to a backpack.

II. Description of the Prior Art

There are many previously known backpacks of the type comprising a front panel and a rear panel which, together, define an article carrying chamber therebetween. A pair of shoulder straps are secured to the pack so that, with the shoulder straps positioned over the shoulders of the user, the pack is supported on the back of the person. Such backpacks are frequently used by students for carrying their books and other school supplies.

One problem with these previously known backpacks, however, is that there is no convenient way to store the backpack, when not in use, in a classroom or other similar situation. Consequently, such backpacks are simply placed on the floor which creates a potential safety hazard from other persons tripping over the backpacks.

SUMMARY OF THE PRESENT INVENTION

The present invention provides a backpack assembly which overcomes all of the above-mentioned disadvantages of the previously known devices.

In brief, the backpack assembly of the present invention comprises a pack having a front panel and a rear panel which are secured together and define a chamber therebetween. Articles, such as school books and the like, are stored within the chamber. A zipper or other conventional structure provides access to the chamber so that articles can be removed from and placed within the backpack chamber as desired.

A pair of shoulder straps are secured to the pack such that, with the straps positioned over the shoulders of the person, the front panel of the pack faces and is generally parallel to the back of the person. Furthermore, with the shoulder straps positioned over the person's shoulder, the backpack is supported on the back of the person.

The present invention further comprises a pad assembly having a first generally planar pad and a second generally planar pad, each having a top, bottom and two sides. The pads are pivotally secured together along the bottom so that the pads are pivotal between a first position and a second position. In their first position, the first panel overlies the second panel whereas in their second position, the second panel is substantially perpendicular to the plane of the first panel.

The top and sides of the first pad are secured to the top and sides of the first panel of the pack. Thus, with the pads in their first position, the pads and front panel of the pack are generally parallel to each other and the second pad is sandwiched in between the first pad and the front panel of the pack. In this position the backpack can be carried in the normal fashion with the pads providing a cushion between the pack and the user's back.

The backpack assembly further includes an opening between the bottom of the pad assembly and the bottom of the front panel of the pack. This opening is dimensioned to receive the back of a chair so that, with the back of a chair positioned between the pad assembly and the pack, the entire backpack assembly is supported by the chair with the backpack positioned behind the back of the chair. Furthermore, with the backpack positioned over the chair, the pad assembly can be moved to a second position whereupon the second pad forms a seat which overlies the chair seat and on which the user sits.

BRIEF DESCRIPTION OF THE DRAWING

A better understanding of the present invention will be had upon reference of the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
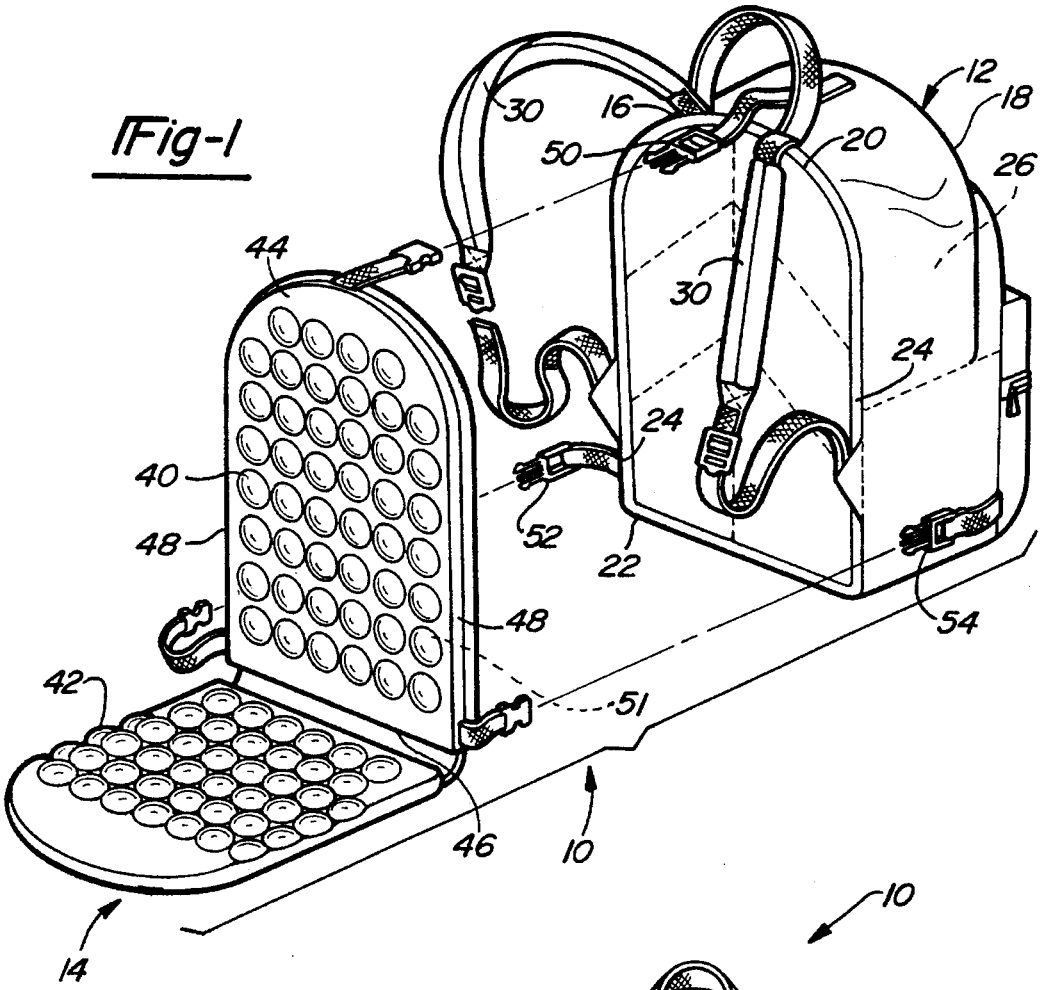
FIG. 1 is an exploded elevational view illustrating a preferred embodiment of the present invention.

With reference first to FIG. 1, a preferred embodiment of the backpack assembly 10 of the present invention is thereshown and comprises a backpack 12 as well as a pad assembly 14. The backpack 12 includes a front panel 16 and rear panel 18. The front panel 16 has a top 20, bottom 22 and two spaced apart sides 24. Furthermore, the front panel 16 and rear panel 18 are secured together and form an article carrying chamber 26 therebetween. A zipper or other conventional means, provides selectively access to the chamber 26.

Still referring to FIG. 1, the backpack 12 includes a pair of shoulder straps 30. One strap 30 extends from the top 20 of the front panel 16 to one side 24 of the front panel 16 adjacent the bottom 22. Similarly, the other strap 30 extends from the top 20 of the from panel 16 to the other side 24 of the front panel 16. Furthermore, as thus far described, the backpack 12 is conventional in construction.

Figure 2:
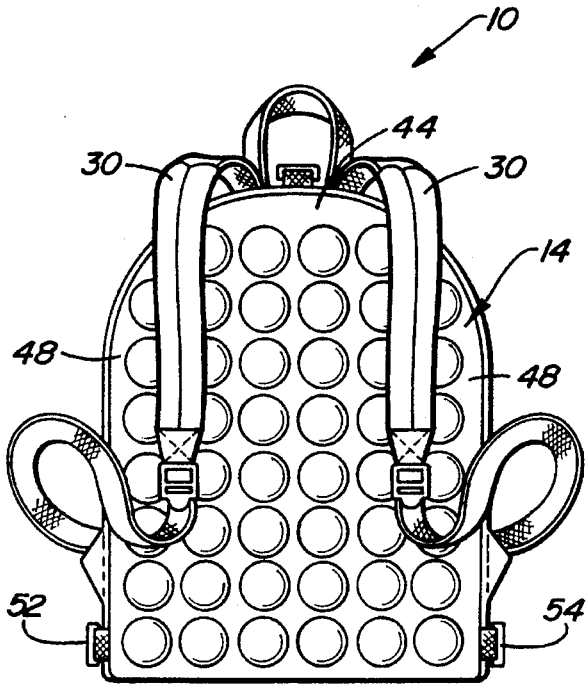
FIG. 2 is a front view illustrating the preferred embodiment of the invention.
Figure 3:
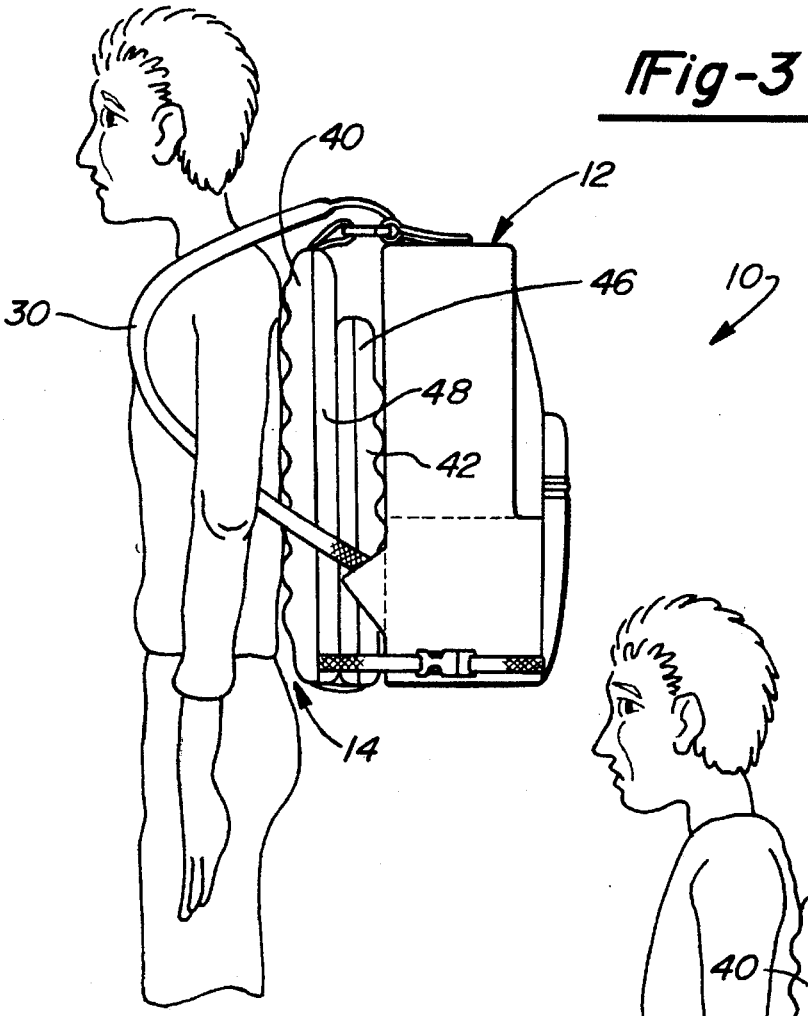
FIG. 3 is a side view illustrating the preferred embodiment of the present invention.

Referring now to FIGS. 1–3, the pad assembly 14 comprises a first pad 40 and a second pad 42. Each pad 40 and 42 are generally rectangular and planar in shape and, as such, include a top 44, bottom 46 and two sides 48. The pads 40 and 42 are substantially the same size as each other and, additionally, are substantially the same size as the from panel 16 of the pack 12.

The pads 40 and 42 are constructed of any conventional cushion material, such as foam rubber or the like. The first pad 40, however, differs from the second pad 42 in that it includes an elongated lumbar support 51 extending between the sides 48 of the first pad 40 adjacent its bottom 46. This lumbar support 51 comprises material which is stiffer or more rigid than the remaining portion of the pad 40.

Figure 4:
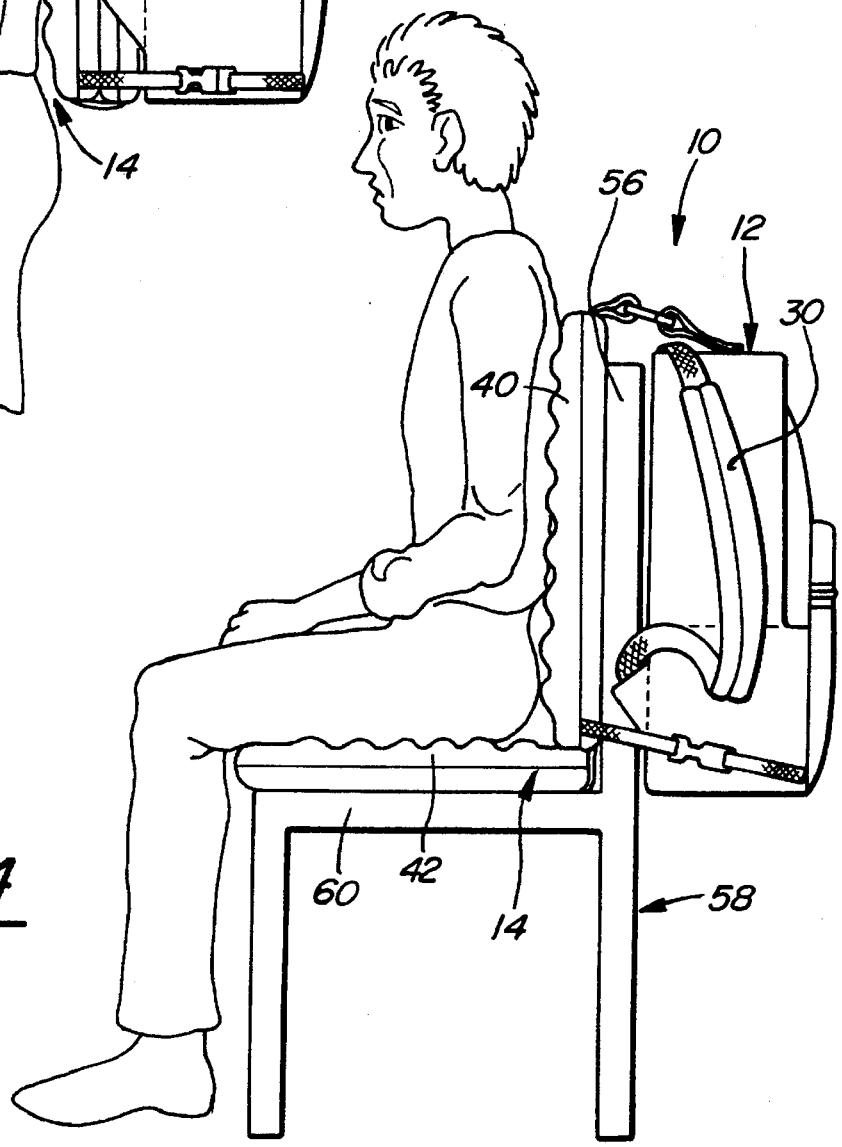
FIG. 4 is a side view similar to FIG. 3, but illustrating the preferred embodiment of the invention positioned over and supported by a chair.

With reference now especially to FIGS. 3 and 4, the bottoms 46 of the pads 40 and 42 are pivotally secured together in any conventional fashion, such as by a sewn seam. The pads 40 and 42 are thus pivotal between a first position, illustrated in FIG. 3 and a second position, illustrated in FIG. 4. In the first position (FIG. 3) the first pad 40 overlies the second pad 42 so that the planes of the pads 40 and 42 are substantially parallel to each other. Conversely, in their second position (FIG. 4) the second pad 40 lies in a plane substantially perpendicular to the plane of a first pad 40.

With reference now to FIGS. 1 and 2, the first pad 40 is secured to the pack 12 by three buckles 50, 52 and 54 or equivalent means. The first buckle 50 secures the top 44 of the pad 40 to the top 20 of the pack front panel 16. The remaining two buckles 52 and 54 secure the opposite sides 48 of the pad 40 to the opposite sides 24 of the pack front panel 16. Preferably the buckles 50, 52 and 54 enable the pad assembly 14 to be detached from the pack 12, although, alternatively, the pad assembly 14 can be fixedly secured to the pack 12.

With reference now to FIG. 3, with the pad assembly in its first position, the second pad 42 is sandwiched in between the first pad 40 and the front panel 16 of the pack 12. In this position, the entire backpack assembly can be carried on the back of a person in the conventional fashion. In doing so, the pad assembly 14 provides cushioning against the user's back.

With reference now to FIG. 4, when the pad assembly 14 is moved to a second position, the back 56 of a chair 58 can be positioned through the opening between the bottoms of the pads 40 and 42 and the bottom 22 of the pack front panel 16. In doing so, the chair back 56 will support the pack 12 on the back 56 of the chair 58 and thus off the floor.

Simultaneously, the second pad 42 is moved from in between the first pad 40 and pack 12 and positioned on the seat 60 of the chair 58. Thus, the first pad 40 overlies the chair back 56 while the second pad 42 overlies the chair seat 60 and provides a comfortable seating surface for the user. When used as shown in FIG. 4, the lumbar support 51 also provides additional support for the user's back.

From the foregoing, it can be seen that the present invention provides a novel backpack assembly. Having described my invention, however, many modifications thereto will become apparent to those skilled in the art to which it pertains without deviation from the spirit of the invention as defined by the scope of the appended claims.

I claim:

1. A backpack assembly adapted to be carried on the back of a person comprising a pack having a front panel, a back panel and a chamber between said panels, said front panel having a top, a bottom and two sides, a pair of shoulder straps secured to said pack such that, with said straps positioned over the shoulders of the person, said front panel faces and is generally parallel to the back of the person, a pad assembly having a first generally planar pad and a second generally planar pad, each pad having a top, a bottom and two sides, means for pivotally securing said bottoms of said pads together between a first position in which said first pad overlies and is substantially parallel to said second pad and a second position in which a plane of said first pad is substantially perpendicular to a plane of said second pad, means for securing the top of said first pad to the top of said front panel, and means for securing said sides of said first pad to adjacent sides of said front panel comprising a pair of straps, one strap extending from each side of said first pad closely adjacent said pad bottom and each said adjacent side of said front panel, wherein said bottom of said first pad is unattached to said pack and dimensioned to receive a chair back between said pad assembly and said pack.

2. The invention as defined in claim 1 wherein each said securing means comprises means for detachably securing.

3. The invention as defined in claim 1 wherein each pad is substantially the same in shape as said from panel.

4. The invention as defined in claim 1 and comprising a lumbar support contained within said first pad.

5. The invention as defined in claim 4 wherein said lumbar support comprises a portion of said first pad that is more rigid than the remaining portion of said first pad.

6. The invention as defined in claim 1 wherein said pads and said front panel are generally rectangular in shape.

* * * * *